United States Patent [19]

Yasue

[11] 4,363,688

[45] Dec. 14, 1982

[54] PROCESS AND APPARATUS FOR PRODUCING FILLING MATERIAL

[75] Inventor: Kazo Yasue, Utsunomiya, Japan

[73] Assignee: Anmin Manufacturing Co., Ltd., Japan

[21] Appl. No.: 266,328

[22] Filed: May 22, 1981

[30] Foreign Application Priority Data

May 26, 1980 [JP] Japan ..... 55-69848

[51] Int. Cl.[3] ..... D02G 3/00

[52] U.S. Cl. ..... 156/251; 156/166; 156/515; 264/143; 264/152; 428/362; 428/398

[58] Field of Search ..... 156/251, 166, 308.4, 156/515; 19/0.3, 0.51, 0.6; 264/143, 152, 163; 428/362, 398, 369, 371

[56] References Cited

U.S. PATENT DOCUMENTS 4,331,502 5/1982 Achelpohl et al. ..... 156/515

*Primary Examiner*—Michael W. Ball

*Attorney, Agent, or Firm*—Barnes, Kisselle, Raisch, Choate, Whittemore & Hulbert

[57] ABSTRACT

Process and apparatus for producing a synthetic filling material comprising a plurality of filaments having a short fiber length and being bent in the form of a loop to be converged to one point and to be integrally bonded at the converged point. A filament bundle formed of a plurality of gathered filaments is inserted among filament bending members to bend the filament bundle zigzag and is heated to cut and bond on the top of the zigzag at one side thereof.

5 Claims, 9 Drawing Figures

PROCESS AND APPARATUS FOR PRODUCING FILLING MATERIAL

BACKGROUND OF THE INVENTION

Natural down and feather are frequently used as fillings of pillows, cushions and quilts. Recently, however, the output of these down and feather can hardly catch up with increasing consumption thereof and price of them is remarkably increasing. Accordingly, development of fillings resembling natural down and feather and being capable of being used like down and feather has been desired. I, an inventor of the present application, have provided a novel filling material made of a plurality of filament which is bent to be loopy configuration.

SUMMARY OF THE INVENTION

The present invention relates to a process and apparatus for producing a filling material resembling natural down and feather.

The object of the present invention is to prepare continuously at a high efficiency from an appropriate number of gathered synthetic fiber filaments tear drop-like or fine circle-like annular fillings having an optional size in which ends of filament bundles converge to one point.

As the starting material of the filling material of the present invention, there are used synthetic fiber bundles comprising an appropriate number of filaments, for example, filament bundles of polyester, nylon or polyacrylonitrile having a fineness of 1.5 to 15 denier, especially about 4 to about 6 denier. Polyester filaments are especially preferred because the Young's modulus is very high. From the viewpoints of the bulkiness and non-entangling property, it is preferred that the cross section of filaments have a circular, trilobal triangular, cinquefoil pentagonal or hexagonal shape.

When such filaments are formed into fillings, in order to prevent entanglement among fillings and produce a good drapability, a smoothening agent or lubricant may be applied to surfaces of the filaments. Furthermore, filaments which have been crimped according to known crimping means may be used in the present invention.

BRIEF DESCRIPTION OF DRAWINGS

FIG. 6-B is a plane view of the filament inserting member in FIG. 6-A,

FIG. 7-B is a plane view of the filament bending member in FIG. 7-A.

DESCRIPTION OF PREFERRED EMBODIMENTS

Embodiments of the apparatus for carrying out the process of the present invention will now be described with reference to the accompanying drawings.

Figures 1, 2, 3:
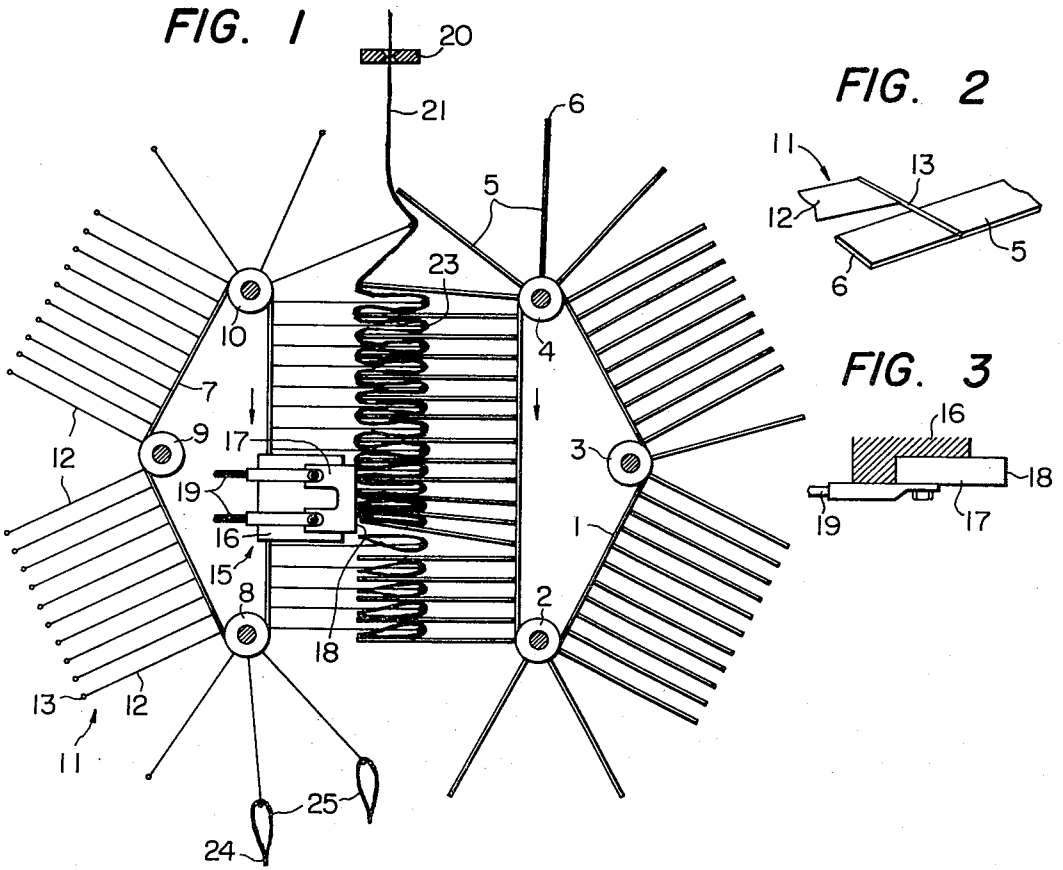
FIG. 1 is a side view illustrating a first embodiment of the apparatus of the present invention.
FIG. 2 is a partial perspective view showing the top end portions of the filament bending member and the filament inserting member of the first embodiment.
FIG. 3 is a partially cut-out plane view showing a melt-cutting and fusion-bonding member of the first embodiment.

The first embodiment is illustrated in FIGS. 1 through 3.

An endless belt 1 consisting of a chain or belt is supported by pulleys 2, 3 and 4 so that a part of the endless belt 1 advances in the vertical direction, and filament bending plate members 5 are equidistantly formed on the periphery of the endless belt 1 so that the members 5 project from the periphery of the endless belt 1 substantially at a right angle to the endless belt 1. The end 6 of each filament bending member 5 is allowed to swing appropriately because of the elasticity of the bending member 5 per se.

An endless belt 7 consists of a chain or belt like the endless belt 1, and the endless belt 7 is supported by pulleys 8, 9 and 10 so that a part of the endless belt 7 advances in the vertical direction in parallel to the vertically advancing part of said endless belt 1. The pulleys 2 and 8 are rotated by a prime mover (not shown), and the endless belts 1 and 7 are moved at the same speed.

Filament inserting members 11 are disposed on the endless belt 7 at the same pitch as that of the filament bending members 5 disposed on the endless belt 1. Each filament inserting member 11 consists of a plate member 12 projecting from the periphery of the endless belt 7 substantially at a right angle to the endless belt 7 and a bar 13 formed on the top end of the plate member 12. The bar 13 is projects from the side portion of the plate member 12 and the direction of the bar 13 is in parallel to the axes of pulleys 2, 3, 4, 8, 9 and 10. The distance between the endless belts 1 and 7 is arranged so that in the state where the endless belts 1 and 7 are in parallel to each other, the filament bending members 5 located in this portion of the endless belt 1 alternate with the bars 13 of the filament inserting members 11 located in this portion of the endless belt 7.

The size of the loop of the feather-like filling described hereinafter is determined by the distance between the end 6 of the filament-bending member 5 and the bar 13 of the filament inserting member 11.

A melt-cutting and fusion-bonding member 15 comprises a supporting member 16 of an insulating material secured to a frame (not shown) and a ⊐-shaped heater 17 attached to the supporting member 16. The front edge 18 of the heater 17 is kept in contact with the end 6 of the filament bending member. A cord 19 is connected to a power source. Reference numerals 20 and 25 represent a guide for a filament bundle 21 and a particle of filling respectively.

The filament bundle 21 is fed to the apparatus having the above-mentioned structure through the guide 20. As shown in FIG. 1, the filament bundle 21 is caught alternately in a zigzag manner on the ends 6 of the filament bending members 5 and the bars 13 of the filament inserting members 11 disposed in the parallel portions of the endless belts 1 and 7. When both the endless belts 1 and 7 are moved at the same speed in the direction indicated by an arrow, the bars 13 of the filament inserting members 11 stuff the filament between two adjacent filament bending members 5 with the movement of the endless belts 1 and 7, whereby U-figured bends are formed in succession in the filament bundle 21 between every two adjacent filament bending members 5 and the filament bundle 21 is bent zigzag.

Such U-figured bend 23 is brought close to the melt-cutting and fusion-bonding member 15 with the movement of the endless belts 1 and 7 in the state where the bend 23 is gripped by the top end 6 of the filament bending member 5, when the end 6 of the filament bending member 5 comes close to the heater 17, the filament 21 which is bent at the position of the end 6 is pressed to the heater 17 by the end 6 of the filament bending member 5 and this portion of the filament bundle is melt-cut and the end portions of the filament bundle near the melt-cut portion are fusion-bonded (24) whereby the U-figured bent filament bundle is formed into a loop by fusion bonding. Namely, each U-figured bent filament bundle is formed into a particle of filling 25 where the ends of the U-figured bent filament converge to the fusion-bonded portion as the convergent point.

With the movement of the endless belts 1 and 7, the filament bending member 5 is then released from the contact of the end 6 with the heater 17 and is allowed to freely swing. The filament inserting member 11 is advanced in the state where the bar 13 carrys the particle of filling 25 thereon, and when the particle 25 reaches almost the lowermost position with turing of the pulley 8, the particle 25 is taken out from the bar 13 by appropriate means and is accumulated at the accumulation position.

The second embodiment is illustrated in FIGS. 4 through 7.

An endless belt 31 is hung on a pulley 33 integrally secured to a shaft 32 to which rotation is transmitted from a driving zone (not shown) and a pulley 35 integrally secured to a shaft 34. Sliding grooves 36 are formed equidistantly on the peripheral face of the endless belt 31 along the entire width of the endless belt 31 in parallel to the shafts 32 and 34. Filament bending members 37 are slidably inserted in the sliding grooves 36. Each filament bending member 37 has an L-figured shape and is formed by punching a plate having an elasticity, and only a butt 38 is projected transversely of the sliding groove outwardly from the sliding groove 36. A falling preventing member 39 for preventing falling of the filament bending members 37 has a bendability and is fitted in the periphery of the endless belt 31. A push cam 40 and a pull cam 41 are secured to a machine frame (not shown) by legs 42 and 43 so that the cams 40 and 41 face the endless belt 31 in the linearly advancing portion of the endless belt 31 and are engaged with the butts 38 of the filament bending members 37.

Pulleys 44 and 45 are secured to the shafts 32 and 34 in the state where the pulleys 44 and 45 are spaced from the pulleys 33 and 35, and an endless belt 46 is supported by the pulleys 44 and 45. The endless belt 46 has the same structure as that of the endless belt 31, and sliding grooves 47 are formed on the peripheral face in parallel to the shafts 32 and 34 at the same pitch as on the endless belt 31. Filament inserting members 48 are slidably inserted in the sliding grooves 47. Each filament inserting member 48 has an L-figured shape like the filament bending member 37 and are formed by punching a plate member, and a bar 50 is formed on the end opposite to a butt 49. A falling preventing member 51 has the same structure as that of the falling preventing member 39. A push cam 52 and a pull cam 53 are secured to a machine frame (not shown) by legs 54 and 55, and when the push cam 52 becomes engaged with the butt 49, the filament inserting member 48 projects to the side portion of the endless belt 46. The filament bending members 37 and the filament inserting members 48 are arranged so that when the filament inserting member 48 thus projects, the bar 50 is located between the projecting filament bending members 37.

A melt-cutting and fusion-bonding member 56 comprises a supporting member 57 of an insulating material secured to a frame (not shown) and a plate-like heater 58 attached to the supporting member 57. The front edge 59 of the heater 58 is brought close to the ends 60 of the filament bending members 37. Reference numerals 61, 62 and 25 represent a guide connected to a power source, a guide for a filament bundle 21 and a particle of filling, respectively.

The process for preparing waddings of the present invention by the apparatus of the second embodiment will now be described.

The filament bundle 21 is fed to the apparatus having the above-mentioned structure through the guide 62. With rotation of the shaft 32, the endless belts 31 and 46 are moved in the direction indicated by arrows. In the endless belt 31, when the butt 38 of the filament bending member 37 fitted in the sliding groove 36 falls in butting contact with the push cam 40, the filament bending member 37 projects to the left in FIG. 4.

Figure 4:
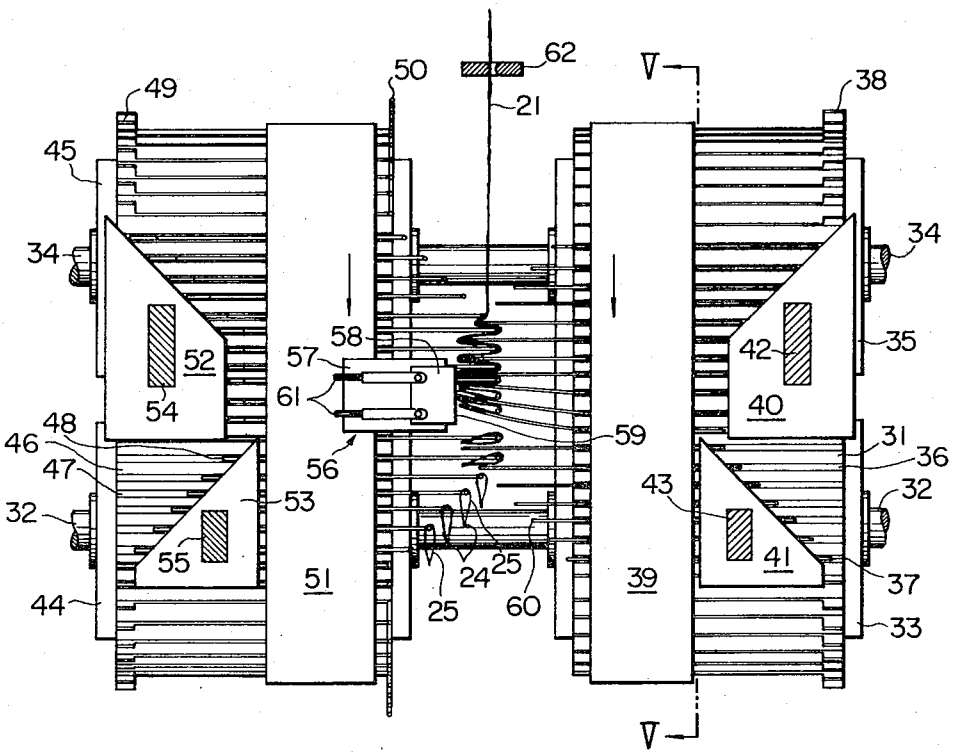
FIG. 4 is a side view illustrating a second embodiment of the present invention.
Figure 6:
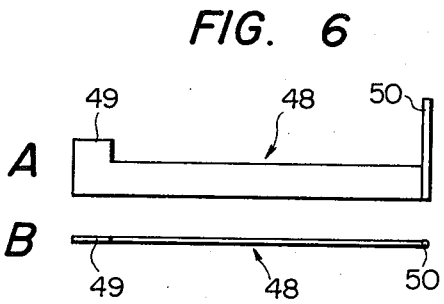
FIG. 6-A is a side view of a filament inserting member of the second embodiment.
Figure 7:
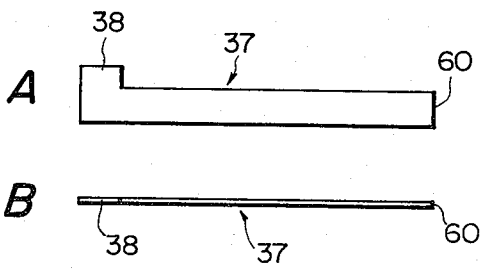
FIG. 7-A is a side view of the filament bending member.
Figure 5:
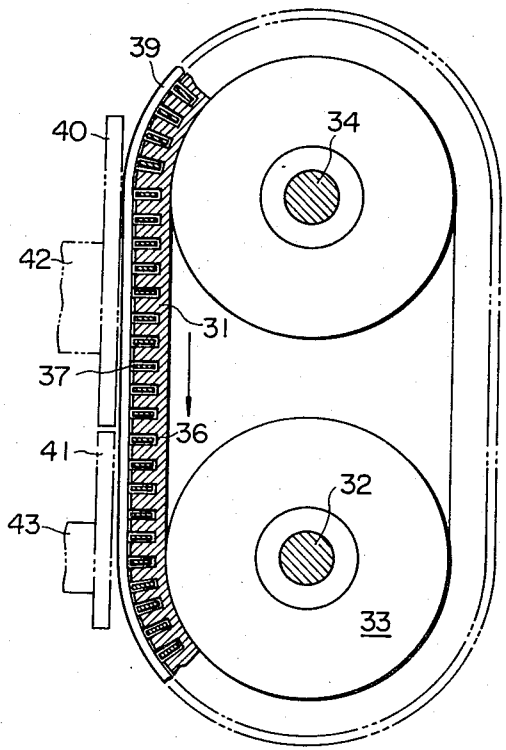
FIG. 5 is a view showing the section taken along the line V—V in FIG. 4.

Simultaneously, the butt 49 of the filament inserting member 48 fitted in the sliding groove 47 of the endless belt 46 falls in butting contact with the push cam 52, the filament inserting member 48 projects to the right in FIG. 4, and the filament bundle 21 is inserted between the ends 60 of the filament bending members 37 by the bar 50 of the filament inserting member 48. Accordingly, the filament bundle 21 is bent zigzag in succession to form U-figured bends 23. Such U-figured bend 23 is brought close to the melt-cutting and fusion-bonding member 56 with the movement of the endless belts 31 and 46 in the state where the bend 23 is gripped by the top end 60 of the filament bending member 37, and when the end 60 of the filament bending member 37 comes close to the heater 58, the filament bundle 21 bent at the position of the end 60 is pushed to the end of the heater 58 by the end 60 of the filament bending member 37 and the bent portion of the filament bundle 21 is melt-cut. The end portions of the filament bundle 21 near the cut portion are fusion-bonded to form a loop of the U-figured bent filament bundle 21. As in the first embodiment, there is formed a particle of filling 25 in which the ends of the U-figured bent filament bundle converge to the fusion-bonded portion 24 as the convergent point.

The particle of filling 25 is advanced with the movement of the endless belts 36 and 46 in the state where the particle 25 is hung down from the bar 50, and when the butts 38 and 49 of the filament bending member 37 and the filament inserting member 48 fall in butting contact with the pull cams 41 and 53, the members 37 and 48 slide in the sliding grooves 36 and 47 of the endless belts 31 and 46 and the filament bending member 37 and the filament inserting member 48 move to the right and the left, respectively and are returned to the original positions. The particle of filling 25 is in the state where the particle 25 is hung down from the bar 50 during the above movement, and the particle 25 is taken out from the bar 50 by appropriate means and is accumulated.

The size of the loop of the particle of filling 25 is freely changed by changing the distance between the pulleys 33 and 44 and the distance between the pulleys 35 and 45 or by changing the shapes of the inclined faces of the push cams 40 and 52.

As will be apparent from the foregoing description, according to the present invention, the filament bundle is stuffed in the U-figured bent state among the filament bending members arranged in parallel to one another by the bars of the filament inserting members and the filaments falling in contact with the ends of the filament bending members are melt-cut and fusion-bonded. Accordingly, feather-like fillings of the tear drop-like form in which the ends of the filaments converge to the fusion-bonded portion as the convergent point can be formed in succession at a high efficiency. Furthermore, by changing the degree of insertion of the filament inserting members into the filament bending members, the sizes of loops of the filaments can appropriately be adjusted.

What is claimed is:

1. A process for producing filling material, which comprises steps of inserting a filament bundle formed of a plurality of arranged filament among a plurality of filament bending members disposed contiguously to one another by filament inserting members in the state where the filament bundle is kept in contact with the end portions of the filament bending members, to bend the filament bundle zigzag, heating and melt-cutting the filament bundle at the parts kept in contact with the end portions of the filament bending members to form two fold filament bundles having a short fiber length and simultaneously fusion-bonding the end portions of the filament bundles near said melt-cut parts, whereby is obtained filling material comprising a plurality of filament having a short fiber length and being bent in the form of a loop, ends of said filaments converging to one point and the converging filaments being integrally fusion-bonded to one another at said convergent point.

2. An apparatus for producing filling material, which comprises two endless members supported by pulleys respectively, a plurality of filament bending members disposed contiguously to one another on the first endless member, a plurality of filament inserting members disposed contiguously to one another on the second endless member, said filament bending members and said filament inserting members being arranged so that they can be advanced between the point where the top ends of the filament bending members confront the top ends of the filament inserting members and the point where the top ends of the filament bending members alternate with the top ends of the filament inserting members, and a heater of a melt-cutting and fusion-bonding member which is disposed at the point where the top ends of the filament bending members alternate with the top ends of the filament inserting members, in the state where the heater is kept in contact with the top ends of the filament bending members, whereby the filament bundles are melt cut at the top of the filament bending members and said melt cut ends fuse to form loops.

3. An apparatus for producing filling material as set forth in claim 2, wherein a part of said endless member advances in parallel to each other with some distances therebetween and said filament bending members and said filament inserting members are equidistantly formed on the periphery of each endless member respectively so that these members project from the periphery of the endless member substantially at a right angle to the endless member.

4. An apparatus for producing filling material as set forth in claim 1, wherein said filament bending member is formed by a material having an elasticity and said filament inserting member provids with a bar which is formed on the top end thereof and projects from the side portion of the filament inserting member in the direction parallel to the axes of pulleys so that the filament bending members alternate with the bars of the filament inserting members when the endless members are in parallel to each other.

5. An apparatus for producing filling material as set forth in claim 2, wherein said endless member is a endless belt, one of said endless belt being hung on pulleys integrally secured to a shaft which is common to that of a pulley for another endless belt, sliding grooves are formed equidistantly on the peripheral face of each endless belt in parallel to the shaft of the pulley, the filament bending members having a butt are slidably inserted in the sliding grooves formed on one of the endless belt, the filament inserting members having a butt and a bar formed on the end opposite to the butt are slidably inserted in the sliding grooves formed on the another endless belt, and two sets of a push cam and a pull cam are disposed on a machine frame respectively so that the cams face each endless belt in the linearly advancing portion of the endless belts and are engaged with the butts of the filament bending members or the butts of the filament inserting members.

* * * * *